United States Patent [19]

Quang

[11] 4,127,084

[45] Nov. 28, 1978

[54] IMAGE SUPPORT FOR DRY DEVELOPMENT DEVICE

[75] Inventor: Pham K. Quang, Dieppe, France

[73] Assignee: La Cellophane, Paris, France

[21] Appl. No.: 811,269

[22] Filed: Jun. 29, 1977

[51] Int. Cl.[2] ..... G03G 15/09

[52] U.S. Cl. ..... 118/657

[58] Field of Search ..... 118/657, 652, 658, 653

[56] References Cited

U.S. PATENT DOCUMENTS

| | | | |
|---|---|---|---|
| 3,572,922 | 3/1971 | Olden | 118/657 X |
| 3,881,446 | 5/1975 | Kurita et al. | 118/657 |
| 3,941,469 | 3/1976 | Okamoto | 118/657 X |

FOREIGN PATENT DOCUMENTS

| | | | |
|---|---|---|---|
| 2,241,104 | 3/1975 | France | 118/157 |
| 3,275,870 | 10/1970 | Japan | 118/157 |
| 5,533,975 | 5/1975 | Japan | 118/157 |

*Primary Examiner*—Werner H. Schroeder
*Assistant Examiner*—Andrew M. Falik
*Attorney, Agent, or Firm*—Sherman & Shalloway

[57] ABSTRACT

A dry development device for reproduction machines, wherein the device includes a rotating magnetic brush for distributing development powder on an image support. The image support is advanced on a planar surface which has an opening therein positioned beneath the magnetic brush. The opening has a plurality of wires stretched thereacross, which hold the image support against the brush, while allowing any development powder which might otherwise adhere to the back of the image support to fall into the opening. The wires are arranged in two groups of parallel, uniformly spaced wires with the wire groups converging and positioned symmetrically in a herringbone pattern. A scraper edge of the toner reservoir is presented against the magnetic brush at an angle substantially perpendicular to the surface of the brush.

6 Claims, 4 Drawing Figures

IMAGE SUPPORT FOR DRY DEVELOPMENT DEVICE

BACKGROUND OF THE INVENTION

1. Field of the Invention

The present invention relates to a dry development device for reproduction machines and, more particularly, to a development of latent images of electrostatic charges formed on image supports that are held in contact with the magnetic brush by a plane guide surface.

2. Technical Consideration and Prior Art

Numerous dry development devices use powder development systems. An example of development devices using a magnetic brush to do this is described in U.S. Pat. No. 2,786,441.

In the direct electrostatic processes, i.e., processes in which the latent image of charges is formed directly on a final support, the following problem arises. The magnetic brush, which has been charged with powder, comes into direct contact with the guide surface, which causes the formation of a bead of powder between the magnetic brush and the guide surface. When, after formation of the latent image of charges, a sheet of paper is carried toward the magnetic brush, it engages under the brush by going through the bead. This forms black streaks on the back of the copy due to adherence of development powder.

SUMMARY OF THE INVENTION

The development device, according to the present invention avoids the aforementioned drawbacks. This is accomplished by providing the planar guide surface with an opening, which is placed approximately below the magnetic brush and with a guide means through which the development powder passes. The guide means is stretched above the opening, so as to maintain close contact between the image support and the magnetic brush.

The presence of an opening under the magnetic brush makes it possible to eliminate the powder bead due to the crushing of the latter against the guide surface. The back of the image support, therefore, remains perfectly clean. However, guide means are provided to allow close contact between the magnetic brush and image support, without which a good development would not be assured. The guide means, while avoiding the formation of the powder bead, permit the evacuation of the excess powder to a recovery tank.

According to a preferred embodiment, the device according to the present invention comprises guide means made up of an assembly of parallel wires forming a grid of non-magnetic and antistatic material.

Suitable known means for regulating the tension and spacing of the guide wires makes it possible to obtain, during development, close contact between the magnetic brush and the image support, the back of which is perfectly clean. This is because of the non-magnetic and antistatic nature of the material of the guide wires. The guide wires are arranged in two groups forming a symmetical herringbone pattern.

A scraper edge of the tower reservoir is presented in a perpendicular relationship against the surface of the magnetic brush.

BRIEF DESCRIPTION OF THE DRAWINGS

A better understanding of the invention may be derived from the following description and the accompanying drawings in which.

DETAILED DESCRIPTION OF THE PREFERRED EMBODIMENT

Figure 1:
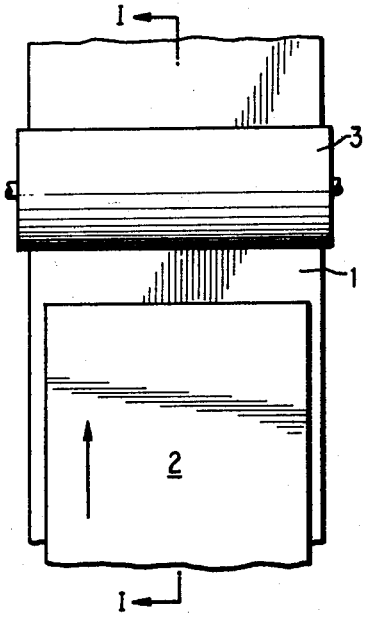
FIG. 1 is a plan view of a prior art developer.

As is shown in FIG. 1, a guide surface 1 guides a sheet 2 which has previously received a latent image of charges. The image of charges is developed by a magnetic brush 3, which is carried by conventional means (not shown).

Figure 2:
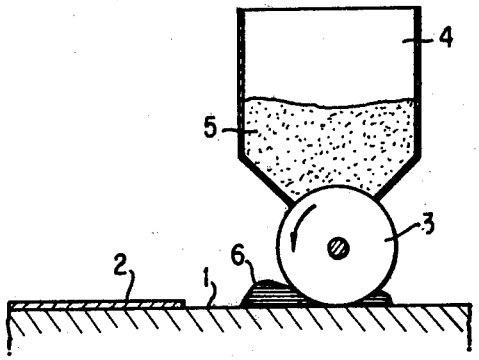
FIG. 2 is a side view of the prior art developer of FIG. 1.

FIG. 2 represents a section along axis I—I of the developer shown in FIG. 1. In this figure, as in the following figures, the same reference numerals designate the same elements as in FIG. 1. The magnetic brush 3 is surmounted by a tank 4, which contains a development powder 5. Under the magnetic brush 3, there is a bead of powder. Actually, to assure correct development of the image of charges present on sheet 2, the contact between the brush 3 and the sheet 2 is necessarily very close, with the consequence that the excess development powder, which is carried by the brush, is deposited on the guide surface and is trapped or crushed there, so that the powder bead 6 occurs. When sheet 2 is delivered under the brush 3, it first passes through this bead, which causes a deposit of development powder on the back of the sheet. This powder on the back of the sheet is then later fixed by heat applied to the back of the copy during passage through the fixing mechanism. A copy coming from such a developer, therefore, always has unsightly black streaks on the back thereof.

Figure 3:
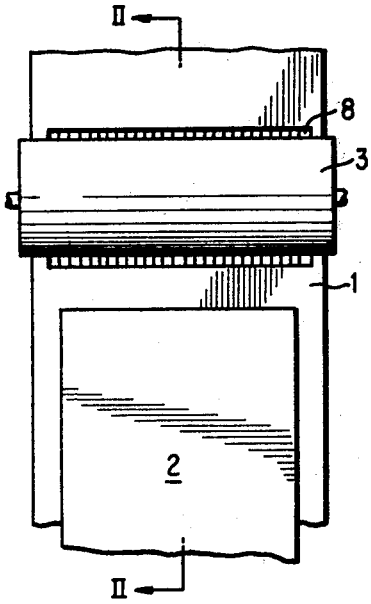
FIG. 3 is a plan view, partly cut away, of a preferred form of developer of the present invention.
Figure 4:
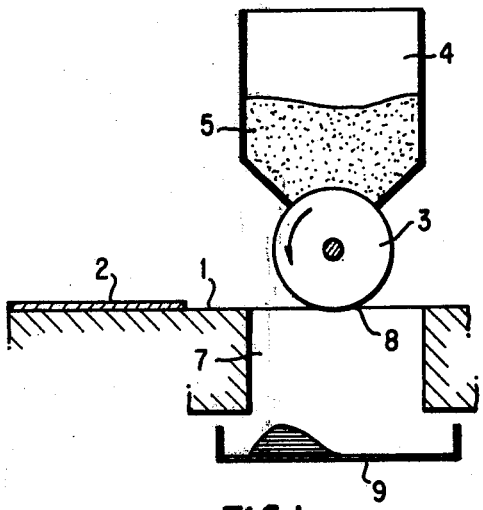
FIG. 4 is a side view of the developer of FIG. 3.

FIG. 3 is a top view of a preferred form of developer according to the present invention. Under the magnetic brush 3 is placed a rectangular opening 7 above which are stretched guide wires 8. Due to this arrangement, the development powder that surrounds the magnetic brush 3 is no longer trapped or crushed on the surface 1 and the prior art powder bead is not formed, as shown in FIG. 4, which is a section along line II—II of the developer of FIG. 3. Actually, since the rectangular aperture 7 is present in the guide surface 1, the contact between the guide surface 1 and the magnetic brush is limited to the contact of the brush with the wires 8. The development powder removed from the brush by the wires is recovered in a tank 9.

The image-carrying sheet 2, which is carried under brush 3 by conventional means not shown in the figure, is held in contact with the brush by the wires 8, the tension of which can be adjusted by any conventional means (not shown). Spacing between wires 8 should be adjusted, so that this contact between sheet 2 and brush 3 remains close. Excellent results may be obtained by spacing the wires 8 1 centimeter apart.

It has been found to be of particular advantage to arrange the wires 8 in two symmetrically converging groups to form a herringbone pattern having its center line substantially coincident with the center line II—II of the path of the copy sheet and the corresponding center of the magnetic brush. The apex of the convergent pattern is directed toward the incoming copy sheet 2.

Preferably, the wires are parallel with the remaining wires in their group and are spaced apart a distance of at least 1 millimeter. Transverse wires may be included, such as by weaving, but the resultant apertures must have a minimum dimension of at least one millimeter.

It has been found to be particularly advantageous to position the basic wires 8 at an angle of between 50° and 55° with regard to the axis of the magnetic brush, although a range of from 45° to 90° is operable.

Most advantageously, the adjacent surface of the magnetic brush is spaced at least 0.5 mm from the plane of the wires 8 but is maintained in very close relationship to ensure full development of the image of copy sheets passing therebetween, with the preferred concurrent motion of the brush surface and the paper surface.

The concurrent motion of the surfaces of the magnetic brush and the image-carrying paper is preferred in order to provide a close-contact relationship therebetween so that the brush can fully develop the image while travelling at relatively low rotational speeds. A countercurrent relationship would require a lesser degree of proximity of the two surfaces, particularly because of resultant frictional effects upon the development. With such greater spacing or lessened contact of the surfaces, higher brush speeds become necessary to provide for full development of the images. The preferred concurrent relationship, however, is responsible for the presence of the roll or bead of trapped developing powder which was a problem in the prior art and which is accomodated by the present invention.

In order that the thickness of the powder will remain constant during development, it is advantageous that the powder tank 4 be provided in its lower part with a slit. The slit should have longitudinal edges, which are approximately the same length as the magnetic brush, so that the lower edges 10 and 11 come in contact with brush 3, and so that they form a scraper and equalize the thickness of the powder along its generatrices. It has been found to be particularly advantageous to align the lower edges 10 and 11 of the tank 4 substantially perpendicular to the brush surface or perpendicular to a tangent at the point of contact with the brush surface, to obtain an excellent filling of toner particles in the brush. The plane of the final edge 10 thus passes through the axis of the brush 3. Alternatively, a separate scraper may be used with the same relationship to the brush surface.

Although a variation of this relationship between 80° and 100° may be used, the 90°, perpendicular relationship has been found to provide a loading of 1.5 mm of toner particles on the brush, as compared to a typical prior art limit of 0.5 mm.

The guide wires used can be of any antimagnetic and antistatic material. The width of the rectangular opening under the magnetic brush should be suited to the diameter of the magnetic brush, the nature and characteristics of the development powder, etc. In practice, the width of this opening should be several centimeters. In any case, it should not be less than 1 mm.

Various changes may be made in the details of the invention, as disclosed, without sacrificing the advantages thereof or departing from the scope of the appended claims.

What is claimed is:

1. A development device for a reproduction machine which produces an image on an image support comprising:

a rotating magnetic brush;

means for rotating the brush and means for loading the brush with powder for development of latent images of electrostatic charges;

means for delivering an image support across said magnetic brush in a direction concurrent with the rotary motion of said brush including a flat planar guide surface having a substantially rectangular opening positioned directly under said magnetic brush, said rectangular opening having long side edges positioned parallel to the axis of rotation of said magnetic brush and generally coextensive with the length of the brush; and two groups of parallel spaced, nonmagnetic wires of antistatic material stretched across said opening in substantially coplanar relationship with said guide surface, the groups arranged to converge toward the center of said brush.

2. The development device of claim 1 in which the rectangular opening has a width of at least 1 mm.

3. The development device of claim 2 in which the wires form an angle of between 50° and 55° with the longitudinal axis of the magnetic brush and the apex of the convergent groups is directed toward said magnetic brush.

4. The development device of claim 2 including a powder recovery tank subjacent said rectangular opening.

5. The development device of claim 3 in which the magnetic brush is surmounted by a tank for containing a supply of development powder, said tank having a slit adjacent the brush and having longitudinal edges generally coextensive with the length of the brush, and a scraper edge is positioned substantially perpendicular to the magnetic brush surface to scrape and equalize the powder charge on said magnetic brush.

6. The development device of claim 5 in which said scraper edge is formed as an edge of said slit in said tank.

* * * * *